US012520915B2

(12) United States Patent
Ferreyra

(10) Patent No.: US 12,520,915 B2
(45) Date of Patent: Jan. 13, 2026

(54) EARRING BACK AND METHOD OF USE

(71) Applicant: In Season Jewelry LLC, Miami, FL (US)

(72) Inventor: Emiliano Francisco Ferreyra, Miami, FL (US)

( * ) Notice: Subject to any disclaimer, the term of this patent is extended or adjusted under 35 U.S.C. 154(b) by 0 days.

(21) Appl. No.: 18/204,809

(22) Filed: Jun. 1, 2023

(65) Prior Publication Data

US 2023/0389664 A1 Dec. 7, 2023

Related U.S. Application Data

(60) Provisional application No. 63/349,372, filed on Jun. 6, 2022.

(51) Int. Cl.
*A44C 7/00* (2006.01)

(52) U.S. Cl.
CPC ..... *A44C 7/003* (2013.01); *A44C 7/001* (2013.01)

(58) Field of Classification Search
CPC ..... A44C 7/003; A44C 7/001
USPC ..... 24/706.9, 662; 63/12, 14.2
See application file for complete search history.

(56) References Cited

U.S. PATENT DOCUMENTS 197,230 A * 11/1877 Shanks ..... A44B 9/14 24/709.8
363,030 A * 5/1887 Wessel ..... A44C 7/003 24/705
511,952 A * 1/1894 Hubash ..... A44C 7/001 63/14.7
1,023,663 A * 4/1912 Kubicek ..... A44B 1/28 24/707.5
1,024,762 A * 4/1912 Anderson ..... A44B 1/28 24/707.5
2,040,289 A * 5/1936 Adams ..... D04B 3/00 D15/78
3,698,044 A * 10/1972 Chernow ..... A44C 7/003 63/12
3,945,089 A * 3/1976 Gagnon ..... A44C 7/003 63/12
4,501,050 A * 2/1985 Fountoulakis ..... A44C 7/003 63/12
4,630,452 A * 12/1986 Connelly ..... A44C 7/003 411/533
4,688,400 A * 8/1987 Chioffe ..... A44C 7/003 63/12

(Continued)

*Primary Examiner* — Jason W San
*Assistant Examiner* — Anna S Rashid
(74) *Attorney, Agent, or Firm* — Kutak Rock LLP; Ryan S. Hinderliter

(57) ABSTRACT

An earring back for secure but easily releasable engagement with an earring post or extension is provided. In an embodiment, the earring back includes an outer casing and an internal, compressible material such as silicone. The earring back further defines a center opening for receiving and engaging with an earring post or extension. In an embodiment, the outer casing comprises two pieces. A first piece is a back piece with an enclosed back end, an open opposite end providing access to an inner cavity, and a lip extending laterally from the open end. The second piece is a front piece having a radius larger than the radius of the lip of the back piece and defining the center opening. In an embodiment, a circumferential portion of the casing front piece is folded over and around a lip of the compressible material and the casing back piece lip and compressed.

18 Claims, 11 Drawing Sheets

(56) References Cited

U.S. PATENT DOCUMENTS 4,843,699 A * 7/1989 Seidman ..... B29C 70/745 29/896.42
4,907,425 A * 3/1990 Elkin ..... A44C 7/003 63/12
4,928,367 A * 5/1990 Seidman ..... B29C 70/745 63/12
5,165,258 A * 11/1992 Kogen ..... A44C 7/00 63/12
5,170,542 A * 12/1992 Greenberg ..... A44C 7/003 63/12
5,632,163 A * 5/1997 Inoue ..... A44C 7/003 63/12
6,138,333 A * 10/2000 Hollingworth ..... A44C 7/003 63/12
6,584,656 B1 * 7/2003 Karmeli ..... A44C 7/003 24/601.5
7,617,576 B2 * 11/2009 Tanio ..... A44C 7/003 63/12
8,365,369 B1 * 2/2013 Fountoulakis ..... A44C 7/003 63/35
D716,685 S * 11/2014 Oh ..... A44C 7/003 D11/88
9,392,849 B1 * 7/2016 Makhoulian ..... A44C 7/003
10,299,547 B2 * 5/2019 Reil ..... A44C 15/0035
10,806,224 B2 * 10/2020 Reil ..... A44C 15/0035
D987,467 S * 5/2023 Reil ..... A44C 7/003 D11/88
11,857,039 B2 * 1/2024 Elam ..... A44C 7/003
2007/0022779 A1 * 2/2007 Christians ..... A44C 27/00 63/35
2010/0162540 A1 * 7/2010 Rissin ..... A44C 7/003 24/705
2011/0191991 A1 * 8/2011 Meneau ..... A44C 7/003 24/705
2014/0023454 A1 * 1/2014 Kikunaga ..... A44B 1/34 411/347
2017/0079387 A1 * 3/2017 Dobashi ..... A44C 7/003
2018/0027932 A1 * 2/2018 Reil ..... A44C 15/0035
2019/0037974 A1 * 2/2019 Bogin ..... A44B 17/0011
2019/0274398 A1 * 9/2019 Reil ..... A44C 15/0035
2023/0052867 A1 * 2/2023 Elam ..... A44C 7/001

* cited by examiner

EARRING BACK AND METHOD OF USE

CROSS-REFERENCE TO RELATED APPLICATIONS

This application claims priority pursuant to 35 U.S.C. § 119(e) to U.S. Provisional Patent Application Ser. No. 63/349,372, filed Jun. 6, 2022.

FIELD OF THE INVENTION

The present invention relates generally to jewelry. More specifically, the present invention is concerned with a protective, secure earring back and methods of use thereof.

BACKGROUND OF THE INVENTION

Jewelry is tremendously popular and commonly worn to complement an outfit, to express oneself, and/or to otherwise make a fashion statement. Amongst jewelry, earrings are particularly prevalent as people of all ages wear earrings daily, and most change earrings often depending on the occasion, the wearer's clothing, or simply the wearer's feeling that day.

A typical earring includes a decorative portion connected to an extended post or alternative extension configured for extending through a piercing hole through a wearer's ear. Most earrings further include an earring back configured to engage with the extended post or alternative extension in such a manner to help keep the earring properly positioned and to help prevent the earring from falling out of the wearer's ear. Nevertheless, each common type of earring back has its disadvantages.

Friction earring backs, also known as butterfly backs, are the most widely used type of earring backs. Friction backs typically include a disk-shaped metal piece defining a center opening and further including connected metal loops spaced at least slightly closer together than the thickness of an earring post or alternative extension to be received. A friction back engages with the earring post or alternative extension by receiving the post or extension through its center opening and gripping or clasping the earring post or extension because of friction between the connected metal loops and post or extension. Nevertheless, with a friction earring back attached, the earring post or alternative extension extends through the friction back such that an end of the earring post or extension is exposed. Such an exposed end can cause pain or discomfort to a wearer if the exposed end pokes into tender skin adjacent to the earring. This can be particularly problematic for children with pierced ear(s) as one or more exposed earring post or extension poking into a child's skin can cause the child pain or discomfort. Similarly, an earring post or extension end poking into skin can cause pain or irritation to those having sensitive skin or other skin conditions. Accordingly, it would be beneficial to have an earring back which protects wearers from being poked by an earring post or extension end.

An additional issue with friction earring backs is that with continual wear over time, the metal loops of a friction earring back push further apart from each other, leading to less friction between the loops and an earring post or alternative extension. Eventually, such a well-worn friction back disengages from an earring post or extension with very little force applied. Once this occurs, such earring backs have a propensity to fall off their corresponding earring posts or extensions, often without a wearer's knowledge, defeating the intended purpose of the earring back and frequently resulting in a lost or broken earring. Some earring posts include one or more grooves designed to catch an earring back from falling off, but such grooves are largely ineffective from preventing a well-used friction earring back from disengaging from an earring post. Accordingly, it would be beneficial to have an earring back which effectively and securely engages an earring post or extension and prevents an earring from falling out of a wearer's ear over a long period of time.

Moreover, friction earring backs can be difficult to grasp and remove, particularly for children and those with various neurological conditions, without pinching one's finger(s) between the metal components of the friction back and/or poking one's finger(s) with the earring post or extension end. Accordingly, it would be beneficial to have an earring back which is quick and easy to remove and which protects a user's finger from being pinched and poked.

Another common type of earring back is a screw-on or threaded earring back. Screw-on earring backs include internal threading designed to engage with a corresponding, externally threaded earring post or alternative extension by threaded connection. While such threaded connection initially provides a secure attachment between earring back and earring post or extension, when utilized on soft metals, such as but not limited to sterling silver or gold, metal on metal friction over time wears down the male and female threads on the earring post and back, respectively, creating an unsecure and ineffective attachment. Furthermore, screw-on or threaded earring backs do not have anything to prevent the internal and external threads from unthreading or coming loose as a wearer moves around. Thus, such earring backs commonly unscrew over time throughout the day until the earring post and back are no longer attached, resulting in the earring back and/or post falling out.

Additionally, children and those with neurological conditions can have difficulty matching up the external threading of a screw-on earring back with the internal threading of an earring post or extension to attach the screw-on earring back. Moreover, many screw-on earring backs leave exposed ends of earring posts or extensions when attached, which can result in an earring post or extension end poking a wearer's skin adjacent to the earring. Accordingly, it would be beneficial to have an earring back which provides quick, easy to use, secure connection to an earring post or alternative extension and which also protects a wearer from being poked by an exposed end of an earring post or alternative extension.

Further available earring backs include silicone, rubber, or compressible plastic earring backs. These silicone, rubber, or compressible plastic earring backs are generally designed to receive an earring post or alternative extension through a central opening smaller than the thickness of the earring post or extension such that insertion of the post or extension through the central opening compresses the silicone, rubber, or plastic and holds the earring back in place around the post or extension. Nevertheless, most silicone, rubber, and compressible plastic earring backs include little or no additional material to provide additional structure to the earring back. Thus, often more of the silicone, rubber, or plastic compresses than desired, resulting in a less secure attachment than other earring backs. Moreover, the compressible nature of the silicone, rubber, or plastic of such earring backs often leads to the earring backs rotating around the earring post or alternative extension when a wearer attempts to remove the earring back from the post or extension. Most silicone, rubber, and compressible plastic earring backs also leave an exposed end of an attached earring post or extension when assembled, which can result in the earring post or extension end poking the wearer. Accordingly, it would be beneficial to have an earring back configured for secure attachment to an earring post or alternative extension, easy grip and removal, and protection from being poked by an earring post or extension end.

Prior to the present invention, there was not an earring back device or method available with the advantages and features described herein.

SUMMARY OF THE INVENTION

The present invention comprises a protective earring back configured for secure but easily releasable engagement with an earring post or alternative extension and methods of use thereof. In an exemplary embodiment, the earring back of the present invention includes an outer metal casing; an internal, compressible silicone material; and a center opening configured to receive and engage with an earring post or alternative extension.

In a preferred embodiment of the present invention, the earring back is substantially cylindrical in shape with one dome-shaped back end and a substantially flat front end having a lip extending outward laterally, wider than the rest of the earring back. In an embodiment, the earring back center opening is open through the center of the substantially flat front end and extends toward the dome-shaped back end, through the internal silicone material. In a preferred embodiment, the domed back end is fully enclosed.

In an exemplary embodiment, the outer metal casing is comprised of two pieces. In an embodiment, a first piece of the outer casing is a substantially cylindrical back piece with a dome-shaped back end; an open opposite end providing access to a hollow, inner cavity; and a lip extending outward laterally from the open end. The second piece of the outer casing, in this embodiment, is a disk-shaped front piece having a radius larger than the radius of the lip of the back piece and defining a center opening. In a preferred embodiment, the casing front piece center opening is sized slightly larger than the thickness of an earring post or alternative extension to which the earring back of the present invention is to be attached.

In an exemplary embodiment of the present invention, the internal silicone material comprises a piece of silicone having a shape similar to but smaller than the shape of the back piece of the outer casing. In an embodiment, the internal silicone material is a piece of silicone which is substantially cylindrical with one dome-shaped end and having a lip extending outward laterally on the end opposite of the domed end. In an embodiment, the piece of silicone material further defines a center opening extending therethrough end to end. In a preferred embodiment, the silicone material center opening is sized at least slightly narrower than the thickness of the earring post or alternative extension to which the earring back is to be attached.

In an exemplary embodiment, the piece of silicone material of the present invention is configured such that the majority of the silicone material, other than the silicone material lip, fits closely within the inner cavity of the outer casing back piece, and the silicone material lip abuts the casing back piece lip, immediately in front of the back piece lip. In an embodiment, with the piece of silicone material placed within the casing back piece inner cavity, the outer casing front piece is placed in front of the silicone material lip, with the casing front piece center opening centered around the silicone material center opening.

In an exemplary embodiment of the present invention, a circumferential portion of the casing front piece is folded back, over, and around the silicone material lip and the casing back piece lip. In embodiments, the front piece fold over is compressed and/or crimped around the lip of the silicone material and the lip of the casing back piece. Such compression and/or crimping encloses the outer casing, forming an assembled earring back of the present invention, and compresses the silicone material lip to prevent rotation of the silicone material within the outer casing.

In an exemplary embodiment of the present invention, an assembled earring back is configured to engage with an earring post or alternative extension by receiving the post or extension through the outer casing front center opening and into the silicone material center opening. In an embodiment, insertion of an earring post or alternative extension into the silicone material center opening compresses the silicone material around the inserted portion of the post or extension, thus gripping the post or extension and helping to hold the attached earring in a proper position in the wearer's ear.

In an embodiment of the present invention, the earring back outer casing protects a wearer from being poked by an end of an earring post or alternative extension. In an embodiment, an earring back of the present invention is utilized with earrings for children. In a further embodiment, an earring back of the present invention is utilized with earrings for people with sensitive skin or other skin conditions. In another embodiment, an earring back of the present invention is used with earrings for people with neurological disorders or conditions.

In an embodiment of the present invention, the earring back provides secure and durable engagement with an earring to be attached. In an embodiment, the present invention includes use of the earring back with an earring post or extension having a threaded back end. Such threaded back end provides for more surface area contact between the silicone material and the post or extension, resulting in a more secure attachment.

In an embodiment of the present invention, an earring back is further configured to be easily gripped for quick and efficient attachment and removal. In an exemplary embodiment, the earring back outer casing includes grooves for easy and ergonomic gripping of the earring back. In an exemplary embodiment, grooves formed in the outer casing further put pressure on and compress the internal silicone material within the metal casing to prevent the internal silicone material from spinning within the casing when an earring post is inserted and/or rotated within the earring back.

In an embodiment of the present invention, construction of the earring back prevents rotation of the internal silicone material within the metal casing, accommodating easy removal of the earring back. In an embodiment, the earring back of the present invention provides a silicone earring back with structure to accommodate effective engagement with an earring post or extension and removal.

The foregoing and other objects are intended to be illustrative of the invention and are not meant in a limiting sense. Many possible embodiments of the invention may be made and will be readily evident upon a study of the following specification and accompanying drawings comprising a part thereof. Various features and subcombinations of invention may be employed without reference to other features and subcombinations. Other objects and advantages of this invention will become apparent from the following description taken in connection with the accompanying drawings, wherein is set forth by way of illustration and example, an embodiment of this invention and various features thereof.

BRIEF DESCRIPTION OF THE DRAWINGS

Embodiments of the present invention are described in detail below with reference to the attached drawing figures, wherein.

Figure 1:
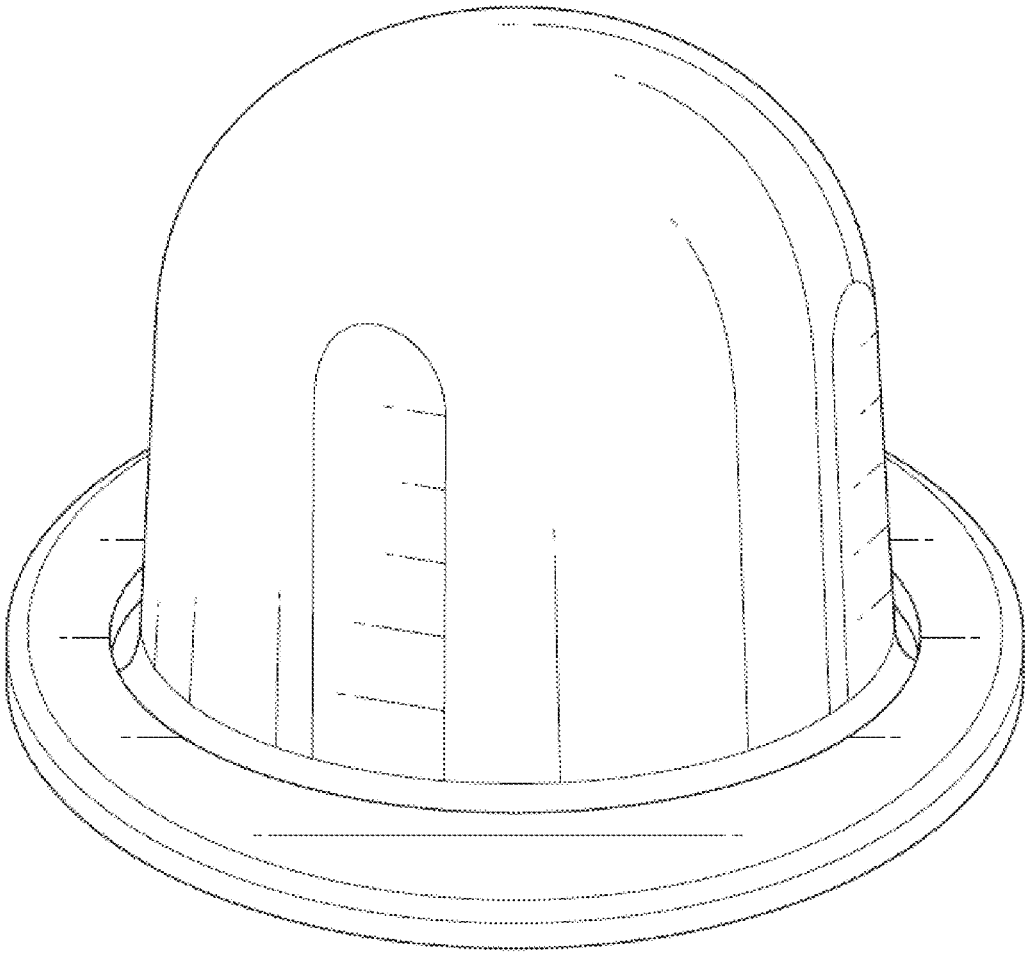
FIG. 1 is a back, perspective view of an earring back embodying the present invention, illustrating an outer casing made up from a front piece with a folded over and compressed circumferential section and a back piece including grip grooves.
Figure 2:
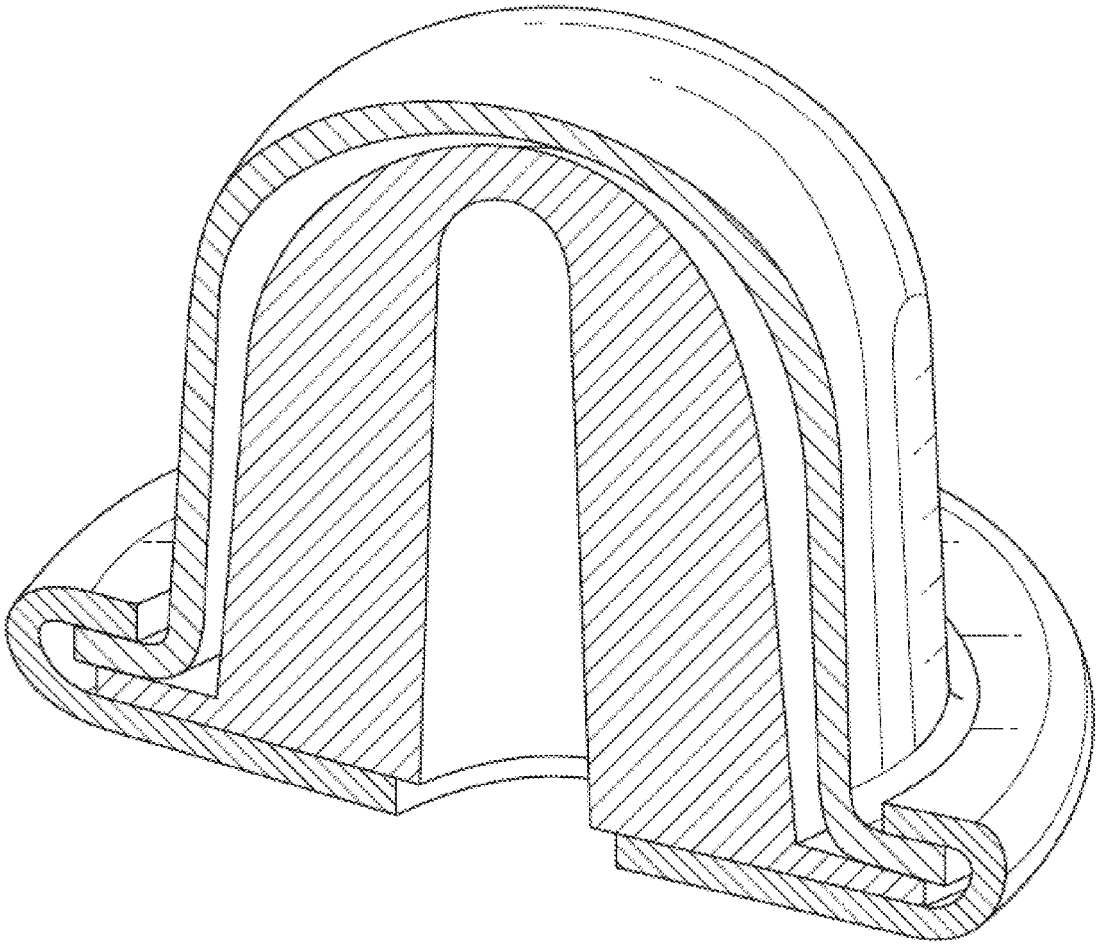
FIG. 2 is a back, perspective, cross-sectional view of the earring back, showing an internal silicone material within the outer casing and emphasizing pressure applied to an outer lip of the silicone material by compression of the outer casing front and back pieces to eliminate rotation of the silicone material within the outer casing. Grooves apply pressure to the silicone to maintain placement of the post
Figure 3:
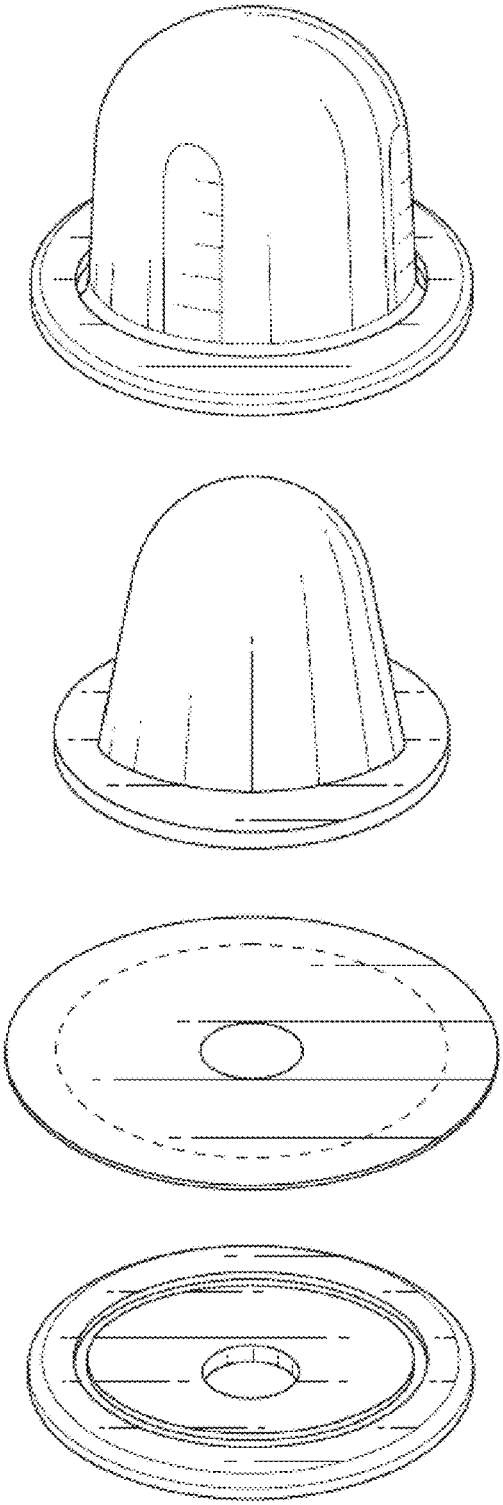
FIG. 3 is a back, perspective, exploded view of the earring back, showing each of the individual components and including views of the outer casing front piece before and after folding of the circumferential section.
Figure 4:
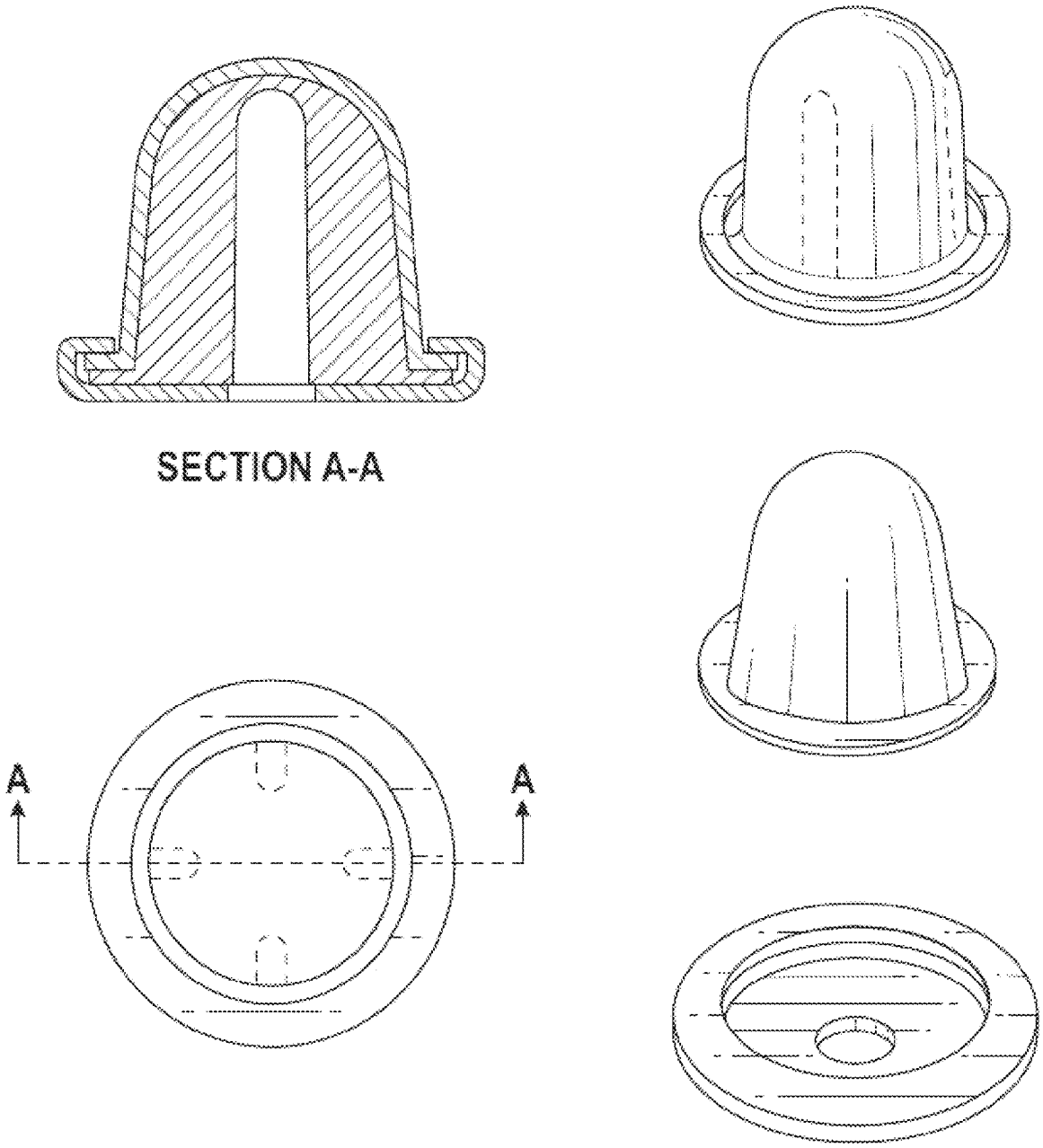
FIG. 4 shows a back, perspective, exploded view; a back, elevational view; and a top, plan, cross-sectional view of an earring back of the present invention.

The drawing figures do not limit the present invention to the specific embodiments disclosed and described herein. The drawings are not necessarily to scale, emphasis instead being placed upon illustrating the principles of the invention.

DETAILED DESCRIPTION OF THE PREFERRED EMBODIMENTS

As required, a detailed embodiment of the present invention is disclosed herein; however, it is to be understood that the disclosed embodiment is merely exemplary of the principles of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

The present invention comprises an earring back and method configured for engagement with an earring post or alternative extension and for retaining an attached earring within a wearer's ear. Multiple views of embodiments of the present invention are shown in FIGS. 1-11. In an exemplary embodiment, the earring back of the present invention is configured to cover the back end of an earring post or alternative extension to protect a wearer from being poked or punctured. In an embodiment, the earring back of the present invention is configured for secure, durable attachment to an earring post or extension. In an embodiment, the earring back of the present invention accommodates easy gripping and quick release from an attached earring post or extension.

In an exemplary embodiment of the present invention, the earring back comprises an outer casing; an internal, compressible material; and a center opening configured for engagement with an earring post or alternative extension. In a preferred embodiment, the outer casing comprises an outer metal casing. In embodiments, the outer metal casing is made up of silver, gold, platinum, palladium, or other precious metal(s). In alternative embodiments, the outer casing is made of other metals or other non-metal, rigid material(s), such as but not limited to rigid plastic. In this application, any description of outer metal casing may be replaced with alternative rigid material(s) without diverting from the present invention. In a preferred embodiment, the internal, compressible material comprises a compressible silicone material configured for returning to its initial form after being compressed. In other embodiments, the internal, compressible material comprises rubber, compressible plastic, or any other compressible material configured for returning to its initial form after being compressed. In this application, any description of silicone material may be replaced with alternative compressible material(s) without diverting from the present invention.

In an exemplary embodiment, the earring back of the present invention is substantially cylindrical in shape with one dome-shaped back end and one substantially flat front end having a lip extending outward laterally, wider than the rest of the earring back. In an exemplary embodiment, the earring back center opening is open through the center of the substantially flat front end and extends toward the dome-shaped back end, through the internal silicone material. Preferably, the dome-shaped back end of the earring back is fully enclosed. In an alternative embodiment, the dome-shaped back end includes an opening. In further embodiments, the earring back does not include a dome-shaped end and includes a substantially flat back end. In further embodiments, the earring back is substantially thimble-shaped or forms any other geometric shape configured for housing an internal, compressible material and for receiving an earring post or alternative extension.

In an exemplary embodiment of the present invention, the outer metal casing is comprised of two metal pieces. In an embodiment, a first piece of the outer casing comprises a substantially cylindrical back piece having a dome-shaped back end; an open end opposite the domed end leading into to a hollow, inner cavity; and a lip extending outward laterally from the open end. In this embodiment, a second piece of the outer casing comprises a disk-shaped front piece which extends outward laterally further than the lip of the casing back piece. The casing front piece further defines a center opening configured to receive an earring post or alternative extension. In a preferred embodiment, the casing front piece center opening is substantially circular and sized slightly larger than the thickness of an earring post or extension to be engaged.

In an exemplary embodiment, the outer casing further includes a series of grip grooves to allow a user to easily grip the earring back. In an embodiment, the grip grooves form an ergonomic shape for comfortable finger placement. In embodiments, grip grooves are formed or molded into the shape of the outer casing. In embodiments, any number of grip grooves can be positioned around the outer casing of the earring back, and the grip grooves can be any length, width, or shape. In embodiments, the outer casing includes one, two, three, four, five, six, seven, eight, nine, 10, 11, 12, or any other number of grip grooves. In alternative embodiments, the outer casing does not include grip grooves. In further embodiments, additional grip material is applied to the exterior of the outer casing to accommodate easy gripping.

In an exemplary embodiment, the internal silicone material of the present earring back comprises a piece of silicone shaped similarly to but smaller than the shape of the outer casing back piece. In an embodiment, the internal silicone material comprises a piece of silicone which is substantially cylindrical with one dome-shaped end and having a lip extending outward laterally from the end opposite of the dome-shaped end. In alternative embodiments, the silicone material is an alternative shape configured to fit closely within the inner cavity of the casing back piece. In an exemplary embodiment, the piece of silicone material further defines a center opening extending therethrough end to end. In other embodiments, the silicone material includes a center opening which extends from a front end of the silicone material into the silicone material a length toward the back end but ending short of the silicone material domed end. In a preferred embodiment, the silicone material center opening is substantially circular and sized at least slightly narrower than the thickness of an earring post or alternative extension to be engaged.

In an exemplary embodiment of the earring back of the present invention, the silicone material is configured such that the majority of the silicone material, or all of the silicone material other than the silicone material lip, fits closely within the inner cavity of the outer casing back piece, and the silicone material lip sits up against the casing back piece lip, immediately in front of the back piece lip. In an embodiment, with the piece of silicone material placed within the casing back piece inner cavity, the outer casing front piece is placed in front of the silicone material lip, with the casing front piece center opening centered around the silicone material center opening. In a preferred embodiment, the casing front piece center opening is sized at least slightly larger than the silicone material center opening.

In an exemplary embodiment, a circumferential portion of the casing front piece is configured to be folded back, over, and around the silicone material lip and the casing back piece lip. In embodiments, the casing front piece folded over portion is compressed around the lip of the silicone material and the lip of the casing back piece. In embodiments, the casing front piece folded over portion is crimped around the lip of the silicone material and the lip of the casing back piece. In other embodiments, alternative types of compression and pressure are applied to the casing front piece folded over section around the silicone material lip and the casing back piece lip. Such pressure encloses the outer casing and compresses the silicone material lip to prevent rotation of the silicone material within the outer casing, forming an assembled earring back of the present invention.

In an exemplary embodiment, grip grooves formed into the outer casing further apply pressure to the internal silicone material within the metal casing. Such pressure compresses the silicone material to help prevent spinning of the silicone material when an earring post or alternative extension is inserted and/or turned within the earring back. The silicone material being retained in a fixed, rotational position within the metal casing accommodates efficient and effective engagement between the earring back and the earring post or alternative extension.

In an exemplary embodiment of the present invention, an assembled earring back is configured to engage with an earring post or alternative extension by receiving the post or extension through the outer casing front center opening and into the center opening in the silicone material. In an embodiment, insertion of an earring post or alternative extension into the silicone material center opening compresses the silicone material around the inserted portion of the post or extension, thus gripping the post or extension and helping to keep the attached earring positioned properly in the wearer's ear.

Figure 5:
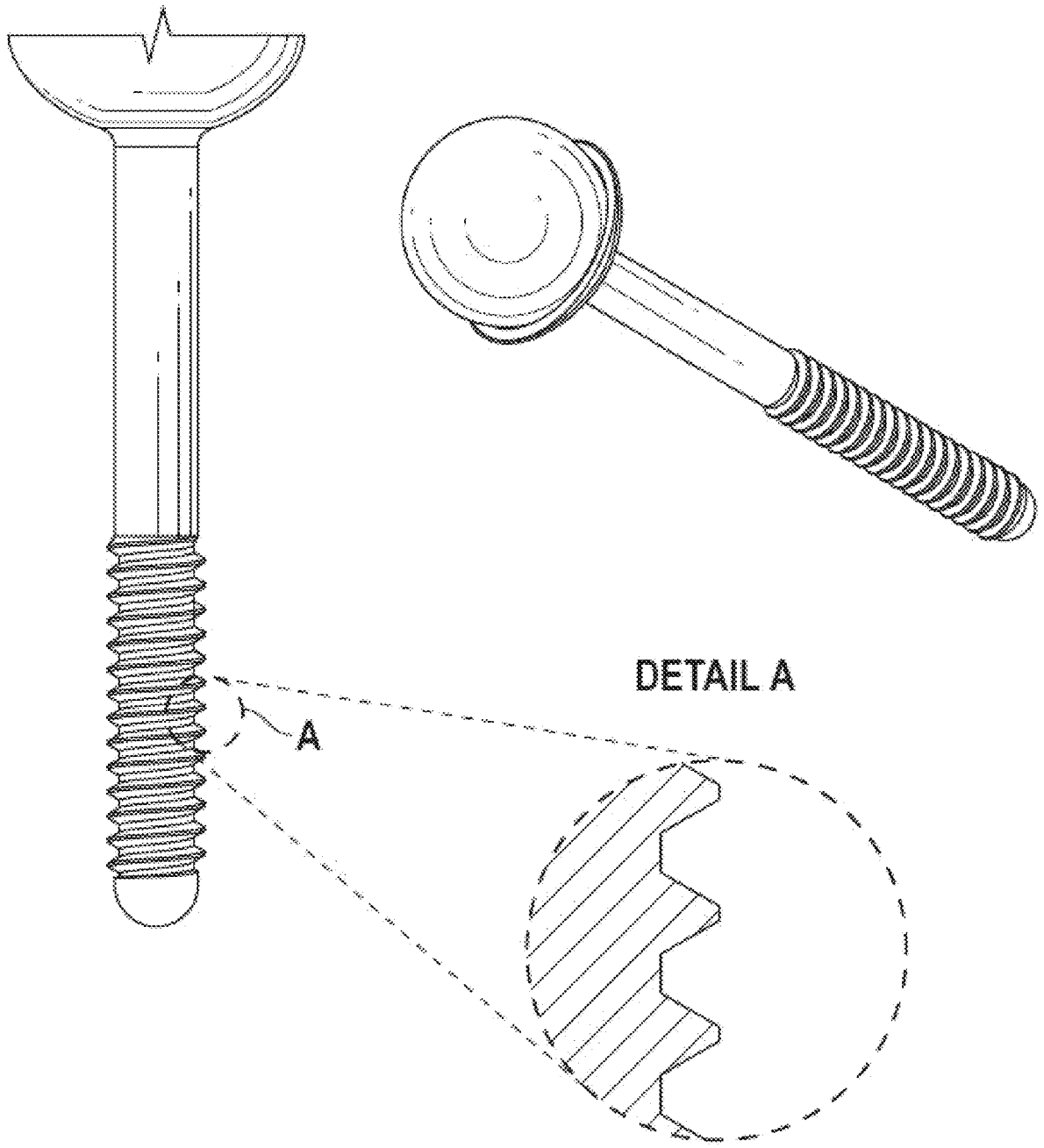
FIG. 5 shows a front, perspective view of an earring configured to engage with an earring back of the present invention; a top, plan view of a post of the earring; and an enlarged, plan view of threading of the earring post.
Figure 6:
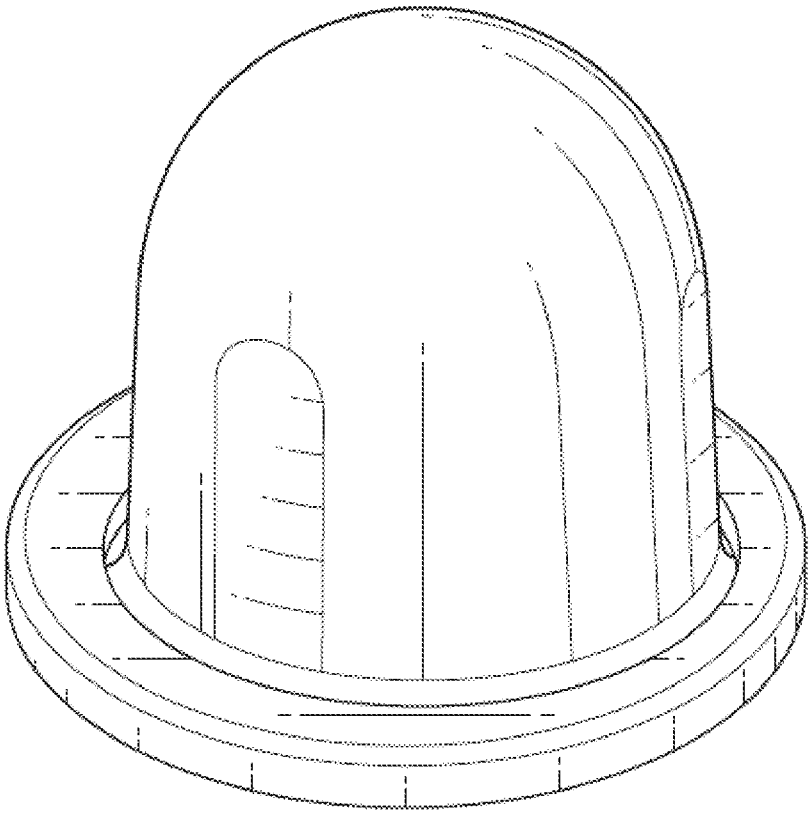
FIG. 6 is a back, perspective view of an earring back embodying the present invention.
Figure 7:
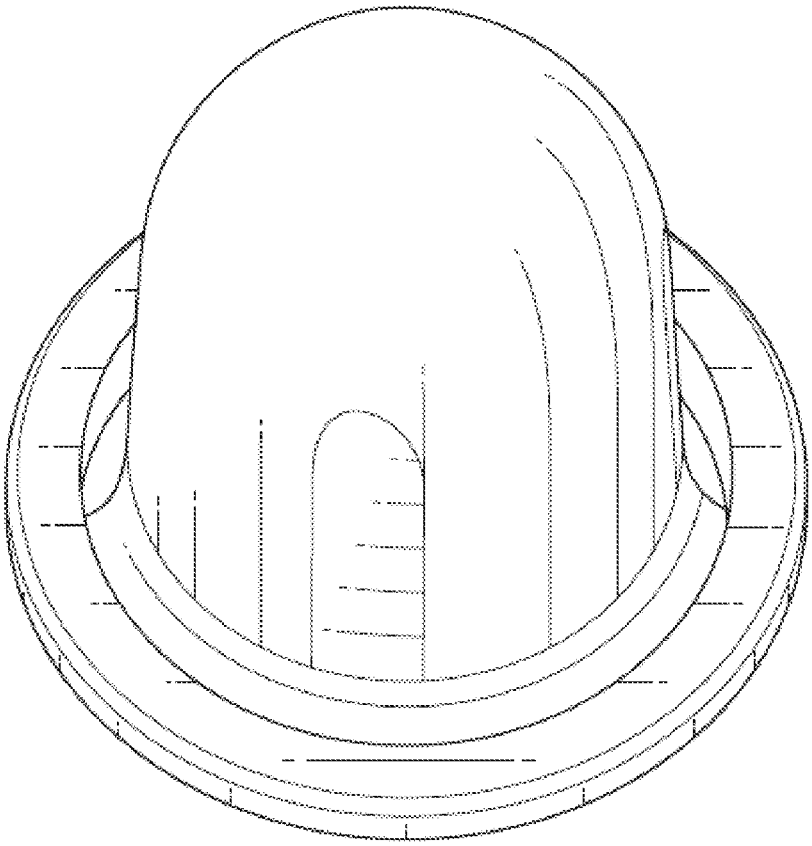
FIG. 7 is another back, perspective view of the earring back, illustrating a grip groove formed into the outer casing of the earring back.
Figure 8:
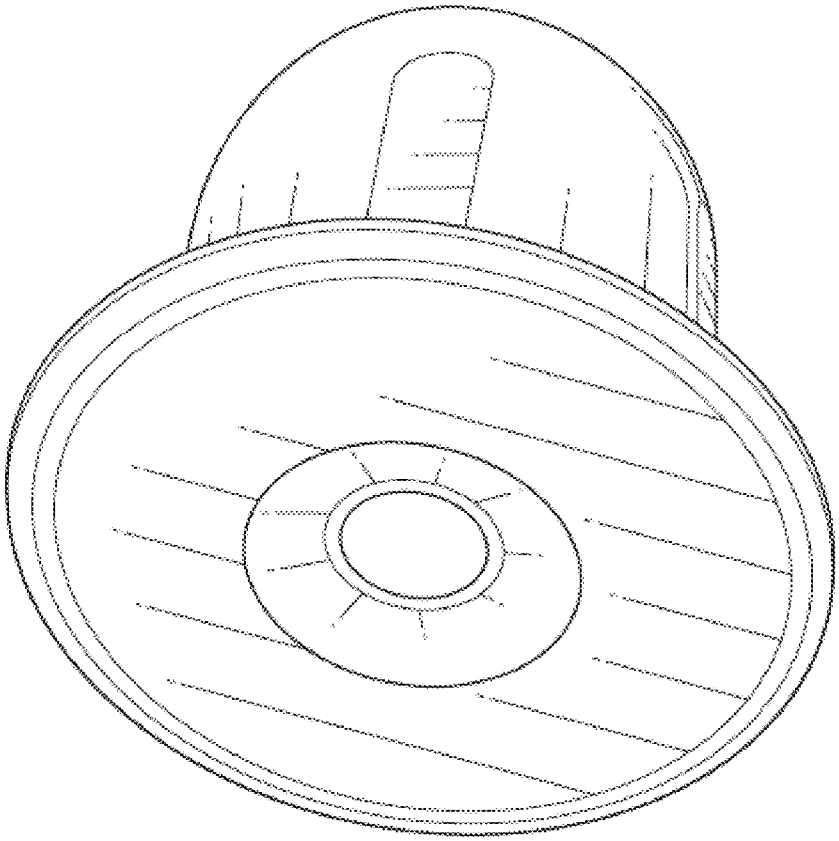
FIG. 8 is a front, perspective view of the earring back.
Figure 9:
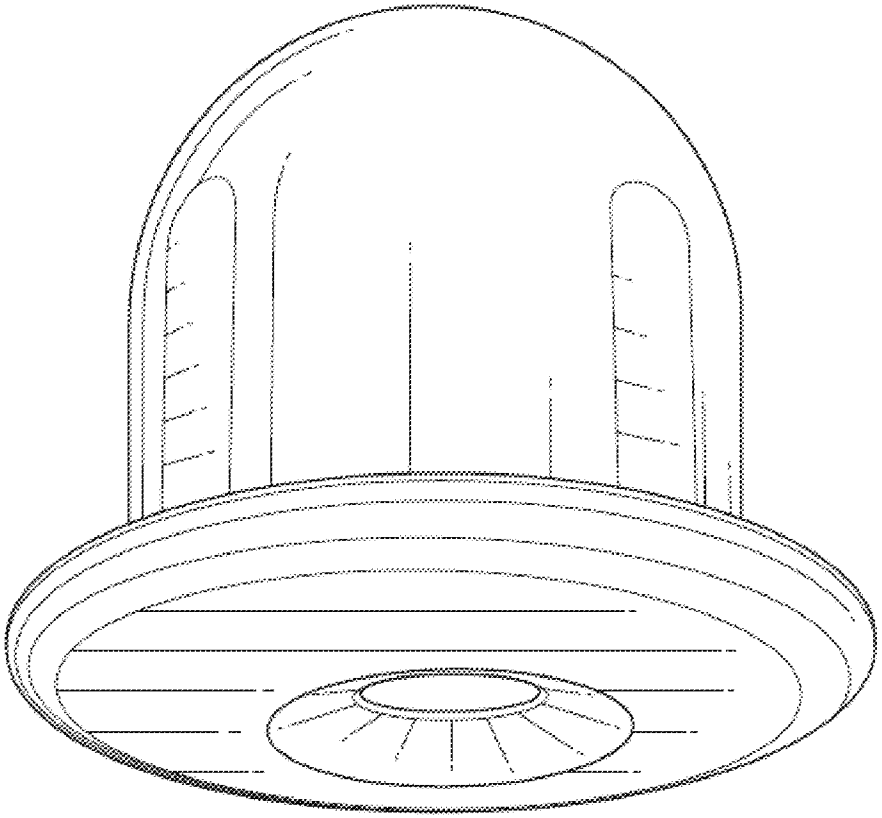
FIG. 9 is a top, perspective view of the earring back.
Figure 10:
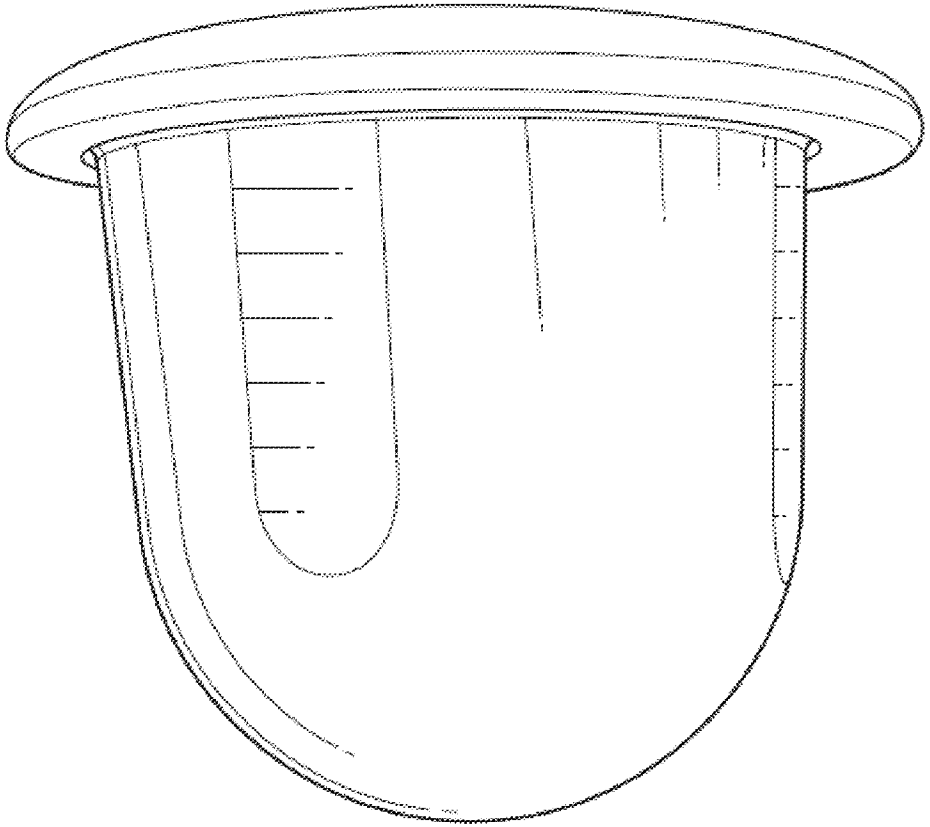
FIG. 10 is a top, plan view of the earring back.
Figure 11:
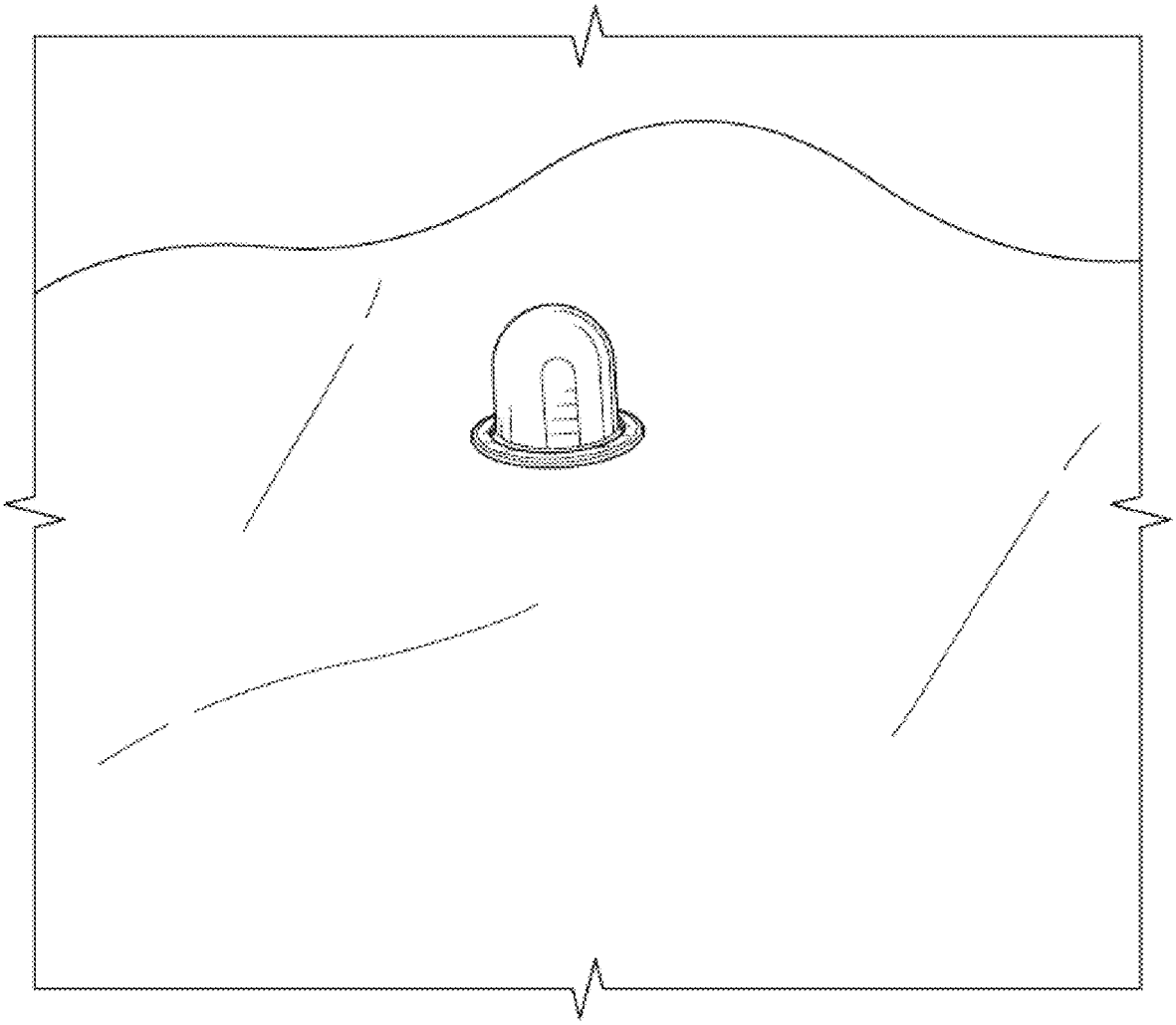
FIG. 11 is a back, perspective view of an earring back embodying the present invention, shown resting on the back of a person's hand for size reference of the particular, non-limiting embodiment shown.

In an embodiment, the present invention includes use of the earring back with an earring post or extension having a threaded back end. Such a threaded back end provides for more surface area contact between the silicone material and the earring post or extension, resulting in a more secure engagement. An example of an earring having a threaded post embodying the present invention is shown in FIG. 5. In embodiments, the earring back of the present invention is configured for engagement with an earring post or extension with no threading. In further embodiments, the present invention includes an earring post or alternative extension including one or more earring back catching grooves or notches.

While use of the present invention with earrings is an exemplary embodiment, the present invention can further be adapted for use with brooches, lapel pins, other decorative pins, or any other device requiring secure, releasable engagement with a post or extension without diverting from the present invention.

Certain terminology is used in the description for convenience in reference only and will not be limiting. For example, up, down, front, back, right, and left refer to the invention as orientated in the view being referred to. The words "inwardly" and "outwardly" refer to directions toward and away from, respectively, the geometric center of the aspect being described and designated parts thereof. Forwardly and rearwardly are generally in reference to the direction of travel, if appropriate. Additionally, anatomical terms are given their usual meanings. For example, proximal means closer to the trunk of the body, and distal means further from the trunk of the body. Said terminology shall include the words specifically mentioned, derivatives thereof, and words of similar meaning.

"Substantially" means to be more-or-less conforming to the particular dimension, range, shape, concept, or other aspect modified by the term, such that a feature or component need not conform exactly. For example, a "substantially cylindrical" object means that the object resembles a cylinder but may have one or more deviations from a true cylinder. "Comprising," "including," and "having" (and conjugations thereof) are used interchangeably to mean including but not necessarily limited to, and are open-ended terms not intended to exclude additional, unrecited elements or method steps.

Changes may be made in the above methods, devices, and structures without departing from the scope hereof. Many different arrangements of the various components depicted, as well as components not shown, are possible without departing from the spirit and scope of the present invention. Embodiments of the present invention have been described with the intent to be illustrative and exemplary of the invention, rather than restrictive or limiting of the scope thereof. Alternative embodiments will become apparent to those skilled in the art that do not depart from its scope. Specific structural and functional details disclosed herein are not to be interpreted as limiting, but merely as a representative basis for teaching one of skill in the art to employ the present invention in any appropriately detailed structure. A skilled artisan may develop alternative means of implementing the aforementioned improvements without departing from the scope of the present invention.

It will be understood that certain features and subcombinations are of utility and may be employed without reference to other features and subcombinations and are contemplated within the scope of the claims. Not all steps listed in the various figures need be carried out in the specific order described.

Having thus described the invention, what is claimed as new and desired to be secured by Letters Patent is:

1. An earring back comprising:

a rigid outer casing comprising an enclosed back end opposite a front end;

said outer casing front end defining an outer casing center opening into an internal cavity of said outer casing and further comprising an outer casing lip which extends outward in a direction substantially perpendicular to a longitudinal length of said earring back;

a compressible material housed within said outer casing and comprising a back end opposite a front end;

said compressible material front end defining a compressible material center opening coaxial with said outer casing center opening and which extends through said compressible material a length toward said compressible material back end;

said compressible material front end further comprising a compressible material lip which extends outward in said direction substantially perpendicular to said longitudinal length of said earring back;

a series of groove indentions formed into said outer casing along the circumference of said outer casing, wherein said groove indentions are configured to compress said silicone material to further prevent rotational movement of said compressible material within said outer casing:

wherein a circumferential portion of said outer casing lip is folded over and compressed around said compressible material lip such that said compressible material lip is compressed into a compressed form so as to prevent rotational movement of said compressible material within said outer casing;

wherein said compressed form of said compressible material lip defines a reduced thickness relative to a non-compressed form;

wherein said outer casing center opening and said compressible material center opening are configured to receive an earring post or extension and said compressible material is configured to engage with said earring post or extension; and wherein said enclosed back end is configured to fully enclose an inserted end of said earring post or extension in an assembled configuration.

2. The earring back of claim 1, wherein said compressible material comprises silicone.

3. The earring back of claim 1, wherein:

said compressible material center opening is sized narrower than the thickness of said earring post or extension such that said compressible material is configured to compress around and grip said earring post or extension when said earring post or extension is inserted into said earring back.

4. The earring back of claim 1, wherein said outer casing is substantially cylindrical in shape.

5. The earring back of claim 4, wherein said outer casing back end is substantially dome-shaped and said outer casing front end is substantially flat.

6. The earring back of claim 5, wherein:

said compressible material is substantially cylindrical in shape with said compressible material back end being substantially dome-shaped and said compressible material front end being substantially flat such that said compressible material is configured to closely fit within said outer casing internal cavity.

7. The earring back of claim 1, wherein:

said outer casing comprises a substantially cylindrical back piece and a substantially disk-shaped front piece.

8. The earring back of claim 7, wherein:

said outer casing back piece comprises a back piece lip;

said outer casing lip comprises said back piece lip in combination with an outer portion of said outer casing front piece;

said compressible material lip is positioned between said back piece lip and said outer casing front piece; and said circumferential portion of said outer casing lip folded over and compressed around said compressible material lip comprises a circumferential portion of said outer casing front piece folded over and around said compressible material lip and said back piece lip and compressed.

9. The earring back of claim 8, wherein said outer casing lip and said compressible material lip are crimped.

10. The earring back of claim 1, wherein said outer casing is made up of metal.

11. An earring comprising:

a decorative portion attached to an extended post configured for extension through a piercing hole in an ear of a wearer;

an earring back comprising a rigid outer casing having an enclosed back end opposite a front end, the outer casing front end defining an outer casing center opening into an internal cavity of said outer casing and further comprising an outer casing lip which extends outward in a direction substantially perpendicular to a longitudinal length of said earring back;

said earring back further comprising a compressible material housed within said outer casing and comprising a back end opposite a front end;

said compressible material front end defining a compressible material center opening coaxial with said outer casing center opening and which extends through said compressible material a length toward said compressible material back end;

said compressible material front end further comprising a compressible material lip which extends outward in said direction substantially perpendicular to said longitudinal length of said earring back;

wherein a circumferential portion of said outer casing lip is folded over and compressed around said compressible material lip such that said compressible material lip is compressed so as to prevent rotational movement of said compressible material within said outer casing;

wherein said outer casing center opening and said compressible material center opening are configured to receive an end of said post opposite said decorative portion and said compressible material is configured to engage with said end of said post opposite said decorative portion and to retain said earring within said ear of said wearer;

wherein said enclosed back end is configured to fully enclose said end of said post opposite said decorative portion in an assembled configuration; and wherein said outer casing defines a series of groove indentions formed into said outer casing along the circumference of said outer casing, wherein said groove indentions are configured to compress said compressible material to further prevent rotational movement of said compressible material within said outer casing.

12. The earring of claim 11, wherein said end of said post opposite said decorative portion comprises threading.

13. The earring of claim 11, wherein said compressible material comprises silicone.

14. The earring of claim 11, wherein:

said outer casing comprises a substantially cylindrical back piece and a substantially disk-shaped front piece;

said outer casing back piece comprises a back piece lip;

said outer casing lip comprises said back piece lip in combination with an outer portion of said outer casing front piece;

said compressible material lip is positioned between said back piece lip and said outer casing front piece; and said circumferential portion of said outer casing lip folded over and compressed around said compressible material lip comprises a circumferential portion of said outer casing front piece folded over and around said compressible material lip and said back piece lip and compressed.

15. A method of manufacturing an earring back comprising the steps of:

forming a rigid outer casing back piece substantially cylindrical in shape with a dome-shaped back end opposite an open front end defining an internal cavity and comprising a back piece lip which extends outward in a direction substantially perpendicular to a longitudinal length of said outer casing back piece;

forming an outer casing front piece substantially disk-shaped with a radius larger than the radius of the back piece lip and defining a center opening sized large enough to receive an earring post or extension;

forming a compressible material component having a back end opposite a front end, said compressible material front end defining a compressible material center opening extending through said compressible material component a length toward said compressible material back end, and said compressible material front end further comprising a compressible material lip which extends outward in a direction substantially perpendicular to a longitudinal length of said compressible material;

placing said compressible material component within said outer casing back piece internal cavity with said compressible material lip abutting said back piece lip;

placing said outer casing front piece in abutting relation to said compressible material front end with said outer casing front end center opening coaxial with said compressible material center opening;

folding a circumferential portion of said outer casing front piece over and around said compressible material lip and said back piece lip; and compressing said back piece lip and an outer portion of said outer casing front piece including said folded over circumferential portion around said compressible material lip, thereby moving said compressible material lip from a non-compressed form to a compressed form;

wherein said compressed form of said compressible material lip defines a reduced thickness relative to said non-compressed form;

wherein said outer casing center opening and said compressible material center opening are configured to receive an earring post or extension and said compressible material is configured to engage with said earring post or extension;

wherein said outer casing back piece is configured to fully enclose an inserted end of said earring post or extension in an assembled configuration; and wherein said outer casing defines a series of groove indentions formed into said outer casing along the circumference of said outer casing, wherein said groove indentions are configured to compress said compressible material to further prevent rotational movement of said compressible material within said outer casing.

16. The method of claim 15, wherein:

said step of compressing said back piece lip and an outer portion of said outer casing front piece including said folded over circumferential portion around said compressible material lip comprises crimping said back piece lip and an outer portion of said outer casing front piece including said folded over circumferential portion around said compressible material lip.

17. The method of claim 15, wherein:

said compressible material center opening is sized narrower than the thickness of said earring post or extension such that said compressible material is configured to compress around and grip said earring post or extension when said earring post or extension is inserted into said earring back.

18. The method of claim 15, wherein:

said compressible material is substantially cylindrical in shape with said compressible material back end being substantially dome-shaped and said compressible material front end being substantially flat such that said compressible material is configured to closely fit within said internal cavity.

* * * * *